US012329281B2

(12) United States Patent
Siao

(10) Patent No.: US 12,329,281 B2
(45) Date of Patent: Jun. 17, 2025

(54) MULTIFUNCTIONAL COLLAPSIBLE PLATFORM

(71) Applicant: Jing Si Pureland Co., Ltd., Taipei (TW)

(72) Inventor: Marshall Q. Siao, Xincheng Township (TW)

(73) Assignee: Jing Si Pureland Co., Ltd., Taipei (TW)

( * ) Notice: Subject to any disclaimer, the term of this patent is extended or adjusted under 35 U.S.C. 154(b) by 694 days.

(21) Appl. No.: 17/666,853

(22) Filed: Feb. 8, 2022

(65) Prior Publication Data

US 2022/0273109 A1 Sep. 1, 2022

(30) Foreign Application Priority Data

Feb. 9, 2021 (TW) ..... 110105145

(51) Int. Cl.
*A47C 19/12* (2006.01)
*A47C 19/02* (2006.01)

(52) U.S. Cl.
CPC ..... *A47C 19/122* (2013.01); *A47C 19/025* (2013.01)

(58) Field of Classification Search
CPC ..... A47C 19/122; A47C 19/025; A47C 19/12; A47C 19/126; A47C 4/08; A47C 4/045;
(Continued)

(56) References Cited

U.S. PATENT DOCUMENTS 1,687,862 A * 10/1928 De Sena Y Freixas ..... A47C 29/006 135/90
5,033,161 A * 7/1991 Chavez ..... E05D 7/1005 16/262

(Continued)

FOREIGN PATENT DOCUMENTS

CN 202060343 U 12/2011
CN 202537818 U 11/2012

(Continued)

OTHER PUBLICATIONS

Extended European Search Report dated Jul. 1, 2022 in corresponding European Application No. 22154639.3.

(Continued)

*Primary Examiner* — Justin C Mikowski
*Assistant Examiner* — Alison N Labarge
(74) *Attorney, Agent, or Firm* — Carlos A. Fisher; Stout, Uxa & Buyan, LLP

(57) ABSTRACT

The present invention provides a collapsible bed frame and a collapsible bed. The collapsible bed frame includes two side bed frames and a plurality of transverse boards, and the plurality of transverse boards are spaced between the two side bed frames. Each side bed frame includes a plurality of collapsible units, hinged to the transverse boards through first hinge elements, and a second hinge element is provided in a middle portion of each collapsible unit, so that the collapsible bed frame is transformable between an expanded state and a collapsed state. Each collapsible unit includes a first side plate and a second side plate. A front surface of the first side plate or the second side plate includes at least a first region and a second region, and the first region protrudes outward relative to the second region. According to the collapsible bed provided in the present invention, the first region on the first side plate or the second side plate (Continued)

protrudes outward relative to the second region. In this way, the stability of the collapsible bed frame in the expanded state can be enhanced.

11 Claims, 18 Drawing Sheets

(58) Field of Classification Search
CPC ..... A47C 29/006; A47B 47/042; A45F 3/52; E05D 7/1022
See application file for complete search history.

(56) References Cited

U.S. PATENT DOCUMENTS

| | | | | | |
|---|---|---|---|---|---|
| 5,385,377 | A | | 1/1995 | Girard | |
| 5,940,934 | A | * | 8/1999 | Turner | E05D 7/1011 16/257 |
| 2016/0220026 | A1 | * | 8/2016 | Siao | A47C 4/045 |
| 2019/0387891 | A1 | * | 12/2019 | Choi | A47C 19/022 |

FOREIGN PATENT DOCUMENTS

| | | | | | |
|---|---|---|---|---|---|
| CN | 203524212 | U | | 4/2014 | |
| CN | 104414234 | A | * | 3/2015 | A47C 19/12 |
| CN | 107692639 | A | * | 2/2018 | |
| JP | H05171747 | A | | 7/1993 | |
| KR | 20180057226 | A | | 5/2018 | |
| TW | 357582 | U | | 5/1999 | |
| TW | M330795 | U | | 4/2008 | |
| TW | M345890 | U | | 12/2008 | |
| TW | M372373 | U | | 1/2010 | |
| TW | M414130 | U | | 10/2011 | |
| TW | M427854 | U | | 5/2012 | |
| TW | M470580 | U | | 1/2014 | |

OTHER PUBLICATIONS

Office Action Dated May 16, 2023 in corresponding Japanese Patent Application No. 2022-015529.

* cited by examiner

300

200

300

200

MULTIFUNCTIONAL COLLAPSIBLE PLATFORM

BACKGROUND OF THE INVENTION

1. Field of the Invention

The present invention relates to a multifunctional collapsible platform, in particular to a multifunctional collapsible bed frame and a multifunctional collapsible bed.

2. Description of the Related Art

Collapsible beds are widely used by virtue of portability and ease of storage. However, for portability, existing collapsible bed frames are generally of relatively lightweight material, sacrificing stability and resistance to damage by compression in the expanded state. Therefore, there is a need to improve on the existing construction.

SUMMARY OF THE INVENTION

In order to resolve the described shortcomings, the present invention provides a multifunctional collapsible bed frame. The collapsible bed frame includes two side bed frames and a plurality of transverse boards spaced between the two side bed frames. Each side bed frame includes a plurality of collapsible units, hinged to the transverse boards through first hinge elements, and a second hinge element being disposed in a middle portion of each collapsible unit, so that the collapsible bed frame is transformable between an expanded state and a collapsed state. Each collapsible unit includes a first side plate and a second side plate, a front surface of the first side plate or the second side plate including at least a first region and a second region, and the first region protruding outward relative to the second region.

In an embodiment, the first region is a region of the first side plate or the second side plate that is close to two edges and/or a middle region of the first side plate or the second side plate.

In an embodiment, a front surface of each of the plurality of transverse boards includes at least a third region and a fourth region, the third region protruding outward relative to the fourth region.

In an embodiment, the plurality of transverse boards includes a middle transverse board, and each first hinge element includes a plurality of first connecting portions and a plurality of first mating portions. The plurality of first connecting portions are spaced on the middle transverse board, and the plurality of first mating portions are disposed on the first side plate of one of two adjacent collapsible units and the second side plate of the other of the two adjacent collapsible units. An insertable portion protrudes from at least one side of each first connecting portion in a first direction, and an insertion groove is recessed on each first mating portion for receiving the insertable portion, so as to hinge the middle transverse board to the side bed frame.

In an embodiment, the insertable portion is hemispherical, and the insertion groove includes a longitudinal groove and a circular groove, to facilitate disassembly and assembly of the collapsible bed frame.

In an embodiment, the plurality of transverse boards includes a transverse headboard, the transverse headboard being hinged to the first side plate or the second side plate through a third hinge element.

In an embodiment, the third hinge element includes a third connecting portion and a third mating portion, the third connecting portion being disposed on one of the transverse headboard and the first side plate or on one of the transverse headboard and the second side plate, the third mating portion being disposed on the other of the transverse headboard and the first side plate or on the other of the transverse headboard and the second side plate, and the third connecting portion being hinged to the third mating portion.

In an embodiment, a plurality of third connecting portions is spaced on the transverse headboard, and a plurality of third mating portions is spaced on the first side plate or the second side plate. A through hole is provided on at least one of the third connecting portions, and the through hole is used for receiving a support element.

The present invention further provides a multifunctional collapsible bed, including the collapsible bed frame as described, and a collapsible bed board, comprising a plurality of bed board units. A fourth hinge element is disposed in a middle portion of each bed board unit, and adjacent bed board units are hinged through a fifth hinge element, so that the collapsible bed board is transformable between an expanded state and a collapsed state, and the bed board units are disposed on the collapsible bed frame in the expanded state.

In an embodiment, each bed board unit includes a first bed board and a second bed board, and the fourth hinge element includes a connecting rod and a plurality of rotary portions. The plurality of rotary portions is sleeved on the connecting rod and respectively disposed on the first bed board and the second bed board, and the rotary portions on the first bed board are offset from the rotary portions on the second bed board.

In an embodiment, the collapsible bed further includes a support element. The support element includes a collapsible support rod and a fixing member, the support rod being fixed in a through hole of the transverse headboard. When the support rod is in an expanded state, the fixing member is disposed at an end of the support rod distal from the transverse headboard.

In an embodiment, the fixing member is made of an anti-slip material.

According to the collapsible bed provided in the present invention, the first region on the first side plate or the second side plate protrudes outward relative to the second region. In this way, the stability of the collapsible bed frame in the expanded state can be enhanced.

PREFERRED EMBODIMENT OF THE PRESENT INVENTION

Figures 1A, 1B, 1C:
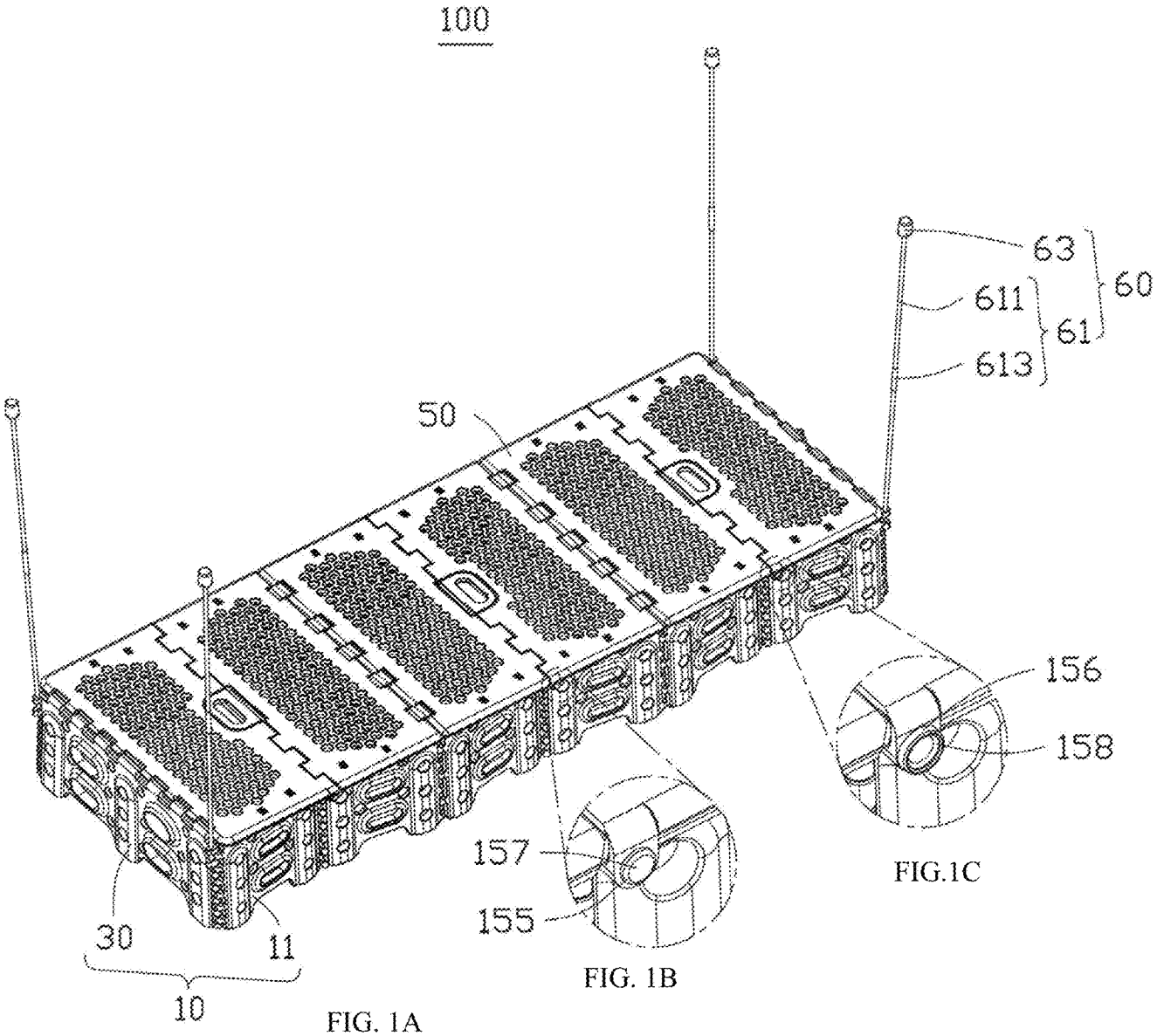
FIG. 1A is a three-dimensional view of a collapsible bed according to an embodiment of the present invention.
FIG. 1B is a magnified view of a portion of the bed shown in FIG. 1A.
FIG. 1C is a magnified view of another portion of the bed shown in FIG. 1A.

The technical solutions in the embodiments of this application are clearly and completely described below with reference to the accompanying drawings in the embodiments of this application. Apparently, the described embodiments are merely some rather than all of the embodiments of this application.

Unless otherwise defined, meanings of all technical and scientific terms used in this specification are the same as those usually understood by a person skilled in the art to which this application belongs. In this application, terms used in the specification of this application are merely intended to describe objectives of the specific embodiments, but are not intended to limit this application.

Some implementations of this application are described in detail below with reference to the accompanying drawings. The embodiments in the present disclosure and features in the embodiments may be mutually combined in case that no conflict occurs.

Referring to FIG. 1A to FIG. 4, the present invention provides a multifunctional collapsible platform (in the current embodiment, a multifunctional collapsible bed) 100. The collapsible bed 100 includes a collapsible bed frame 10 and a collapsible bed board 50. The collapsible bed frame 10 and the collapsible bed board 50 are transformable between an expanded state and a collapsed state.

The collapsible bed frame 10 includes two side bed frames 11 disposed opposite to each other and a plurality of transverse boards 30. The plurality of transverse boards 30 is spaced between the two side bed frames 11.

Since the two side bed frames 11 have the same structure, only a detailed structure of one of the side bed frames 11 (also referred to as "side bed frame 11") is described as follows.

Figure 2:
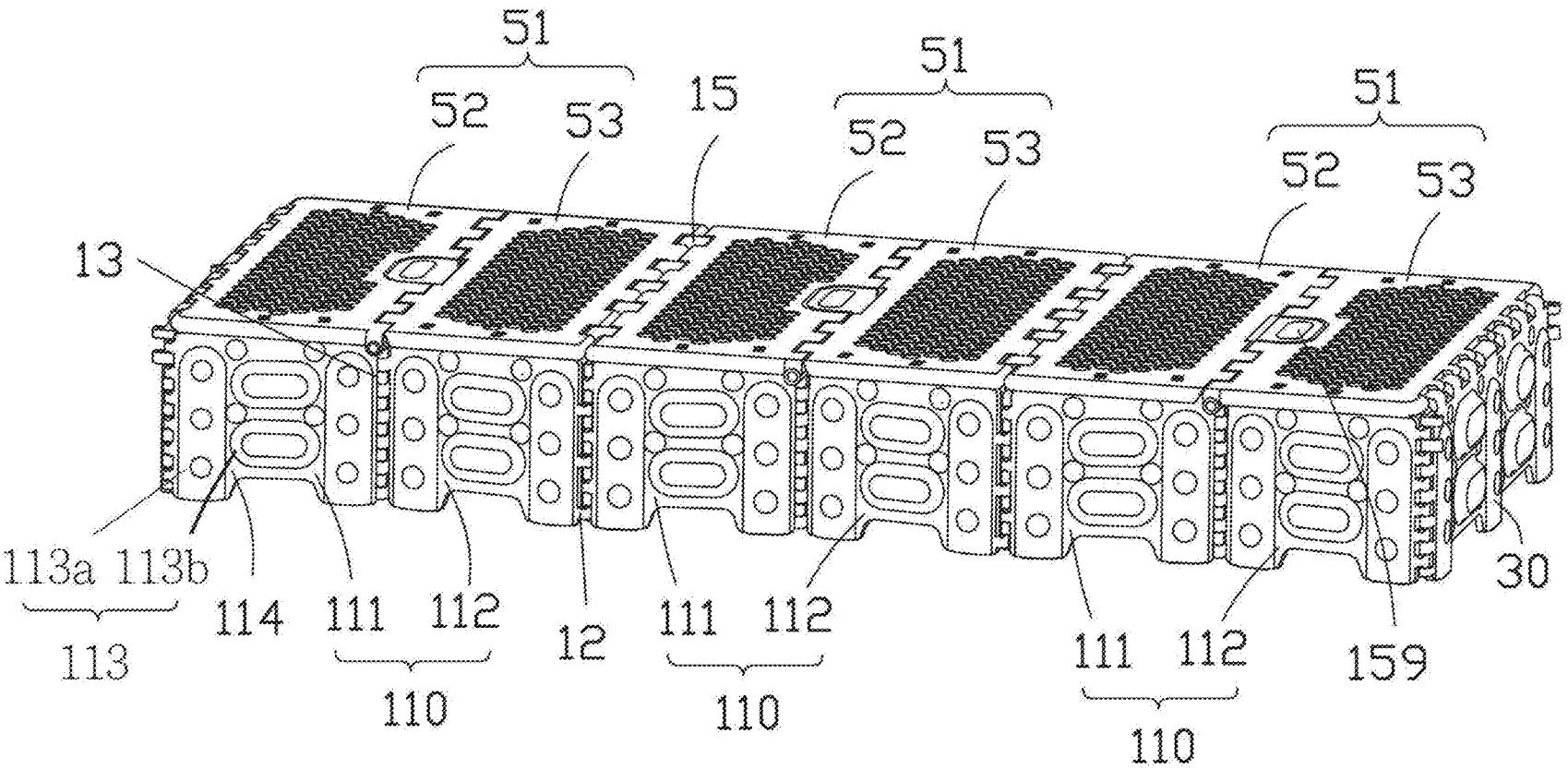
FIG. 2 is a three-dimensional view of the collapsible bed shown in FIG. 1A with support elements removed.
Figure 3:
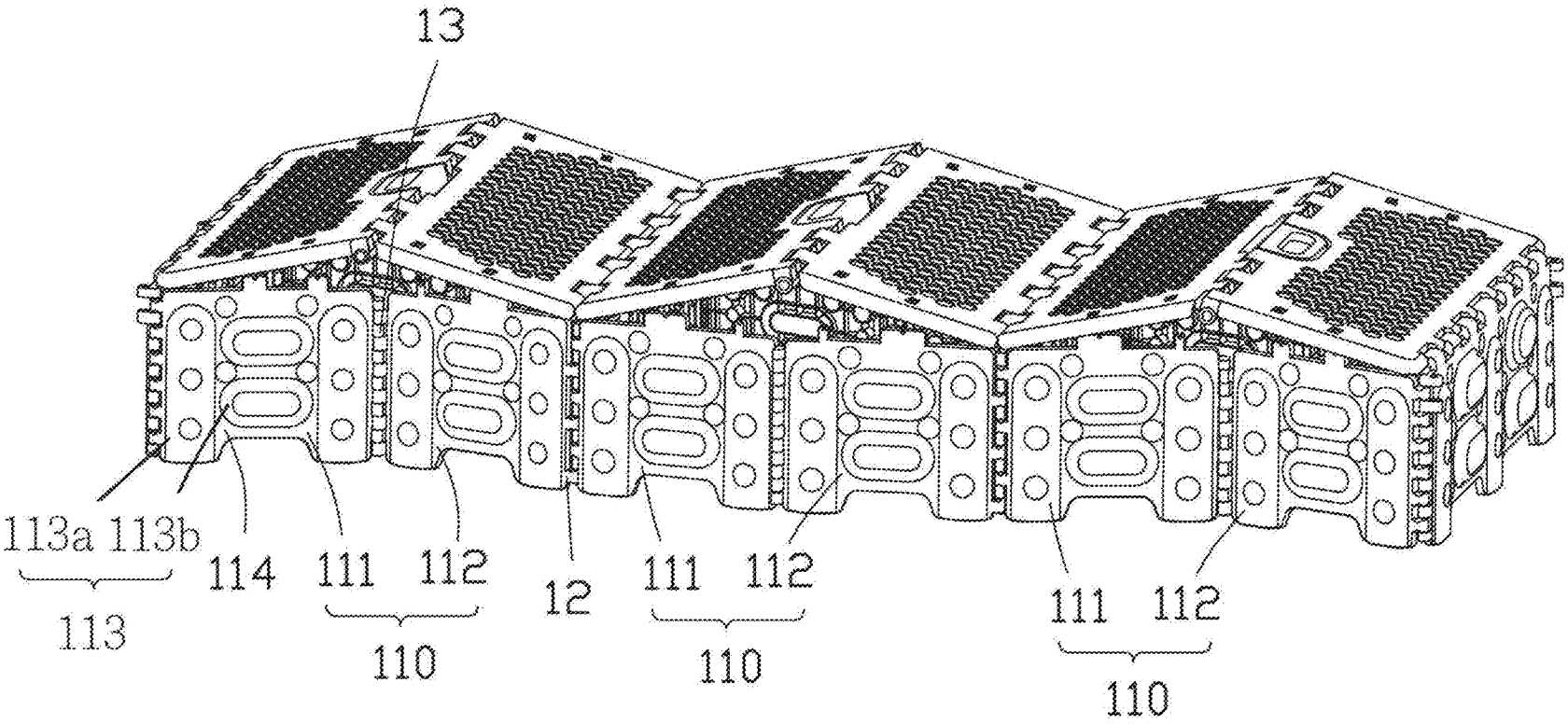
FIG. 3 is a three-dimensional view of the collapsible bed shown in FIG. 2 in a partially-collapsed state.
Figure 4:
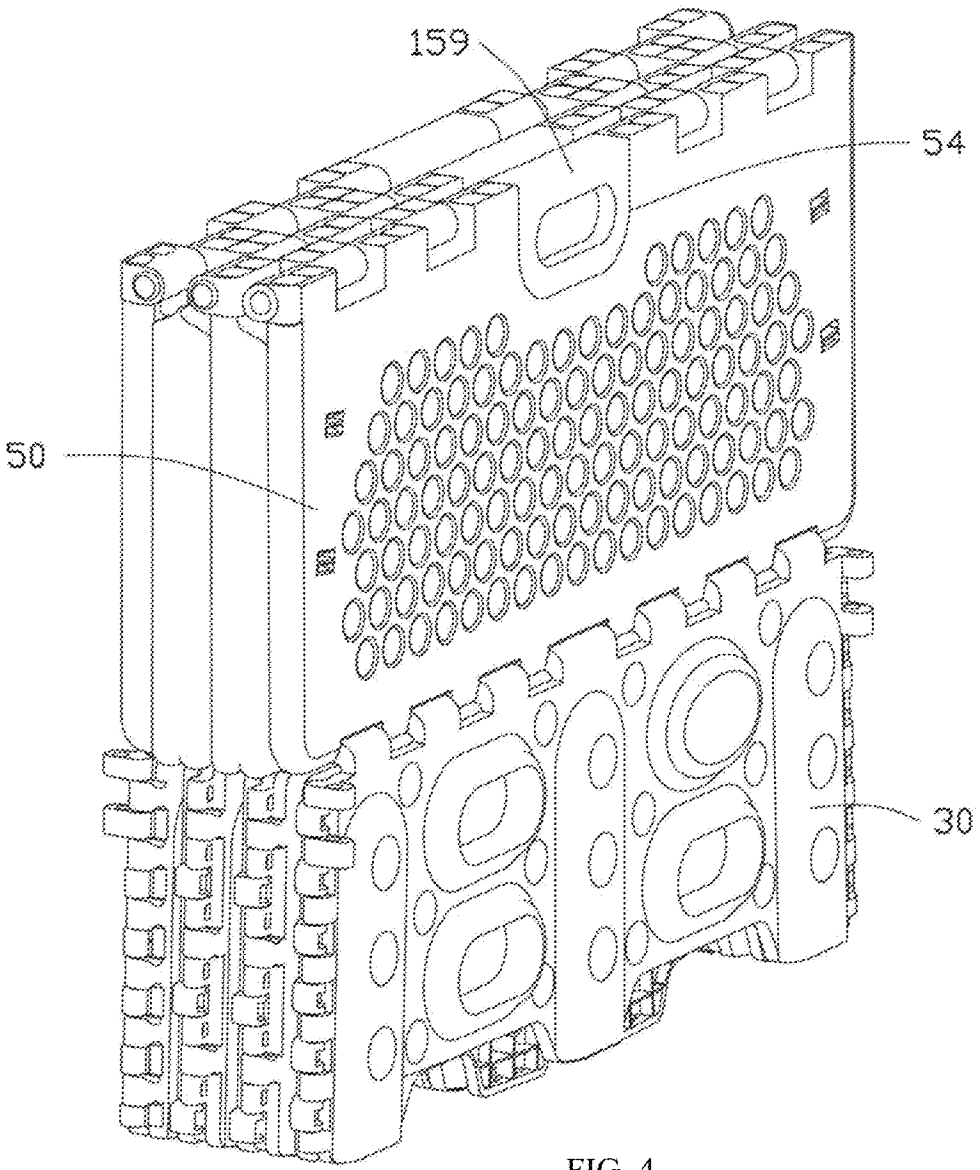
FIG. 4 is a three-dimensional view of the collapsible bed shown in FIG. 2 in a collapsed state.

Referring again to FIG. 2, the side bed frame 11 includes a plurality of collapsible units 110. The plurality of collapsible units 110 is hinged to the plurality of transverse boards 30 through first hinge elements 12, and a second hinge element 13 is disposed in a middle portion of each of the plurality of collapsible units 110, so that the collapsible bed frame 10 is transformable between the expanded state and the collapsed state. As shown in FIG. 2, in the expanded state, the side bed frame 11 is flat, and the plurality of collapsible units 110 of one side bed frame 11 are on the same plane. As shown in FIG. 3, each collapsible unit 110 includes a first side plate 111 and a second side plate 112. In a partially-collapsed state, a first side plate 111 and a second side plate 112 of two adjacent collapsible units 110 of the side bed frame 11 on each side are retracted toward each other, so that the plurality of collapsible units 110 of the side bed frame 11 is collapsed into a "V" shape. As shown in FIG. 4, in a collapsed state, the first side plates 111 and the second side plates 112 of the plurality of collapsible units 110 are overlapped to facilitate storage.

In this embodiment, a front surface of the first side plate 111 or/and the second side plate 112 includes at least a first region 113 and a second region 114. The first region 113 protrudes outward relative to the second region 114.

Figure 5:
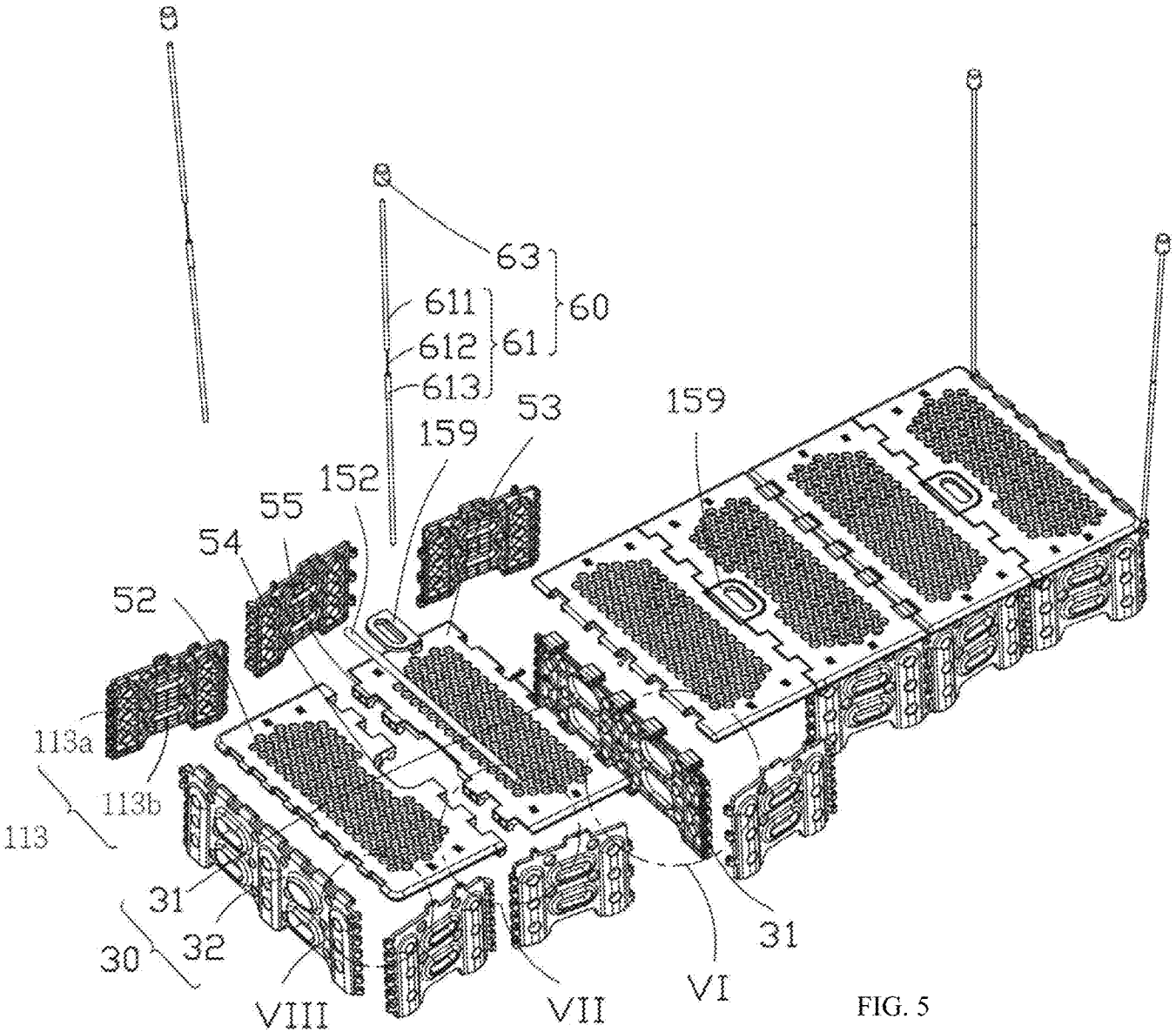
FIG. 5 is a partial structural exploded view of the collapsible bed shown in FIG. 1.

In this embodiment, the first side plate 111 or/and the second side plate 112 include(s) a plurality of first regions 113. The plurality of first regions 113 is respective regions of the first side plate 111 or the second side plate 112 that are close to two edges and/or substantially middle regions of the first side plate 111 or the second side plate 112. As shown in FIGS. 2, 3 and 5, in this embodiment, the second region 114 can be, for example, an outer surface 114 defined by a front surface of the first side plate 111 or/and the second side plate 112. The first region 113 can be, for example, a plurality of hollow protrusions 113 which protrude outward from the outer surface 114. The hollow protrusions 113 include a pair of edge protrusions 113*a* close to two edges of the first side plate 111 or the second side plate 112, on the outer surface 114 thereof respectively, and/or middle protrusions 113*b* located between edge protrusions 113*a*, on the outer surface 114 of the first side plate 111 or the second side plate 112. In this embodiment, the edge protrusions 113*a* and the middle protrusions 113*b* are substantially elongated and orthogonal to each other, and should not be limited to the preceding embodiment.

It would be appreciated that, since the first region 113 on the first side plate 111 or/and the second side plate 112 protrudes outward relative to the second region 114 thereof, the first side plate 111 and the second side plate 112 on the same side are prevented from protruding away from the collapsible bed board when the collapsible bed is bearing weight. In this way, the stability of the collapsible bed frame 10 in the expanded state can be enhanced, while the collapsible bed frame 10 remains portable and easily stored.

Figure 6:
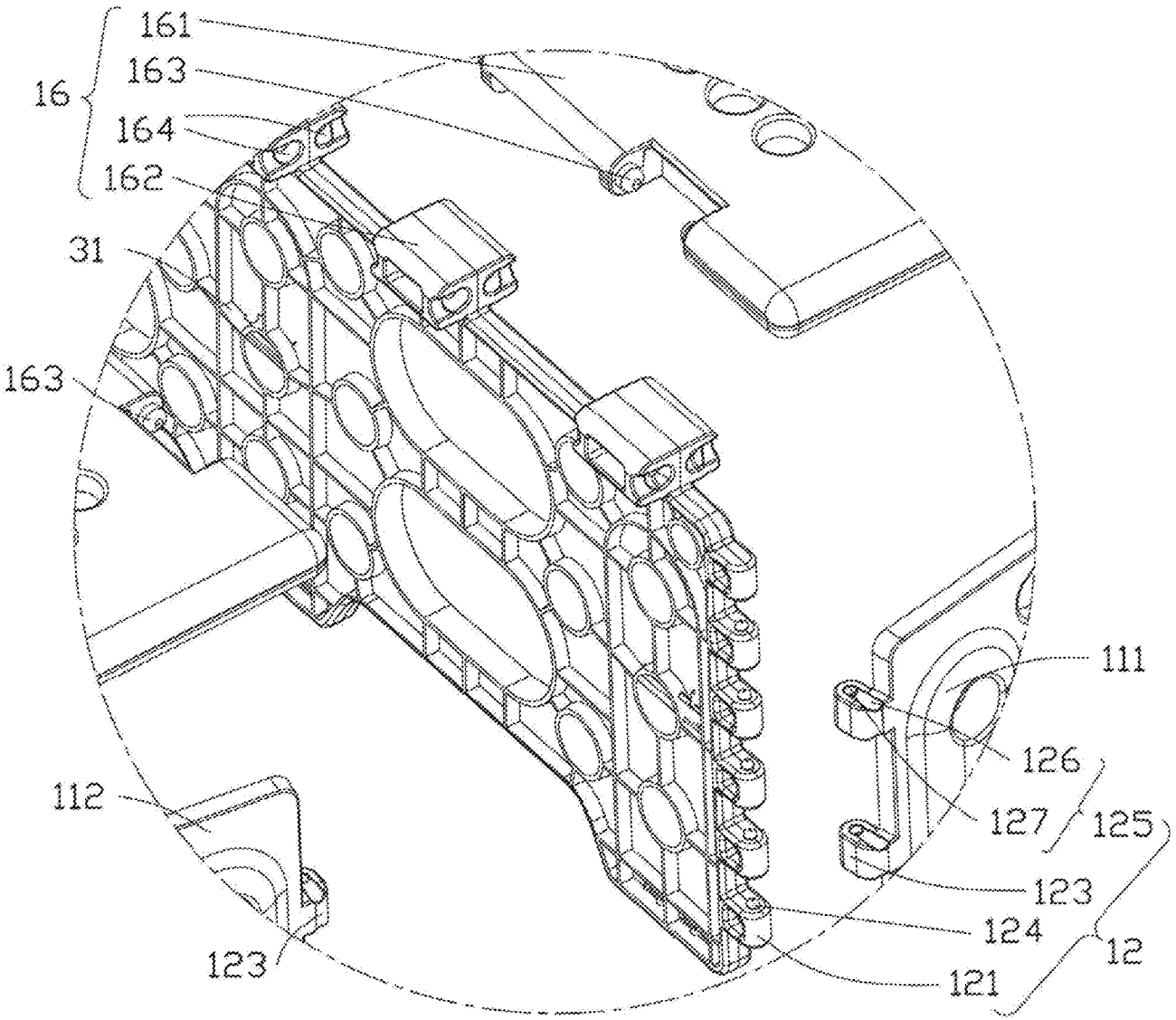
FIG. 6 is an enlarged schematic view of a region VI shown in FIG. 5.

Referring to FIG. 5 and FIG. 6, in this embodiment, the plurality of transverse boards 30 includes a plurality of middle transverse boards 31. Each first hinge element 12 includes a plurality of first connecting portions 121 and a plurality of first mating portions 123. The plurality of first connecting portions 121 is spaced on the middle transverse boards 31. The plurality of first mating portions 123 is spaced on each of the first side plate 111 and the second side plate 112 of the adjacent collapsible units 110, and the first mating portions 123 on the first side plate 111 and the first mating portions 123 on the second side plate 112 are offset. Therefore, during assembly of the first side plate 111 and the second side plate 112, the first mating portions 123 on the first side plate 111 and the first mating portions 123 on the second side plate 112 are staggered. A first insertable portion 124 protrudes from at least one side of each first connecting portion 121 along a height direction of the collapsible bed 100, and a first insertion groove 125 is recessed on each first mating portion 123. Through insertion of the first insertable portion 124 into the first insertion groove 125, the middle transverse board 31 is moveably connected to the side bed frame 11.

In this embodiment, the first insertable portion 124 is hemispherical, and the first insertion groove 125 includes a longitudinal groove 126 and a circular groove 127. In this way, during assembly of the collapsible bed frame 10, the first insertable portion 124 is first impelled along the longitudinal groove 126 and then into the circular groove 127. When the collapsible bed frame 10 needs to be collapsed, action of the first insertable portion is reversed. As a result, expansion and collapse of the collapsible bed 100 can be realized. In addition, the first insertable portion 124 is rotatable in the circular groove 127, so that the collapsible bed frame 10 can alternate between the expanded state and the collapsed state.

It would be appreciated that, when the collapsible bed frame 10 is collapsed, the first mating portions 123 on the first side plate 111 and the first mating portions 123 on the second side plate 112 are rotated in opposite directions.

In this embodiment, the first connecting portions 121 are integrally formed with the middle transverse boards 31, and the first mating portions 123 are integrally formed with the first side plate 111 or the second side plate 112. In other embodiments, the first connecting portions 121 may be fixed to the middle transverse boards 31, and the first mating portions 123 may be fixed to the first side plate 111 or the second side plate 112 by means of welding, snap fitting, or the like and are not limited to the recited embodiment.

Figure 7:
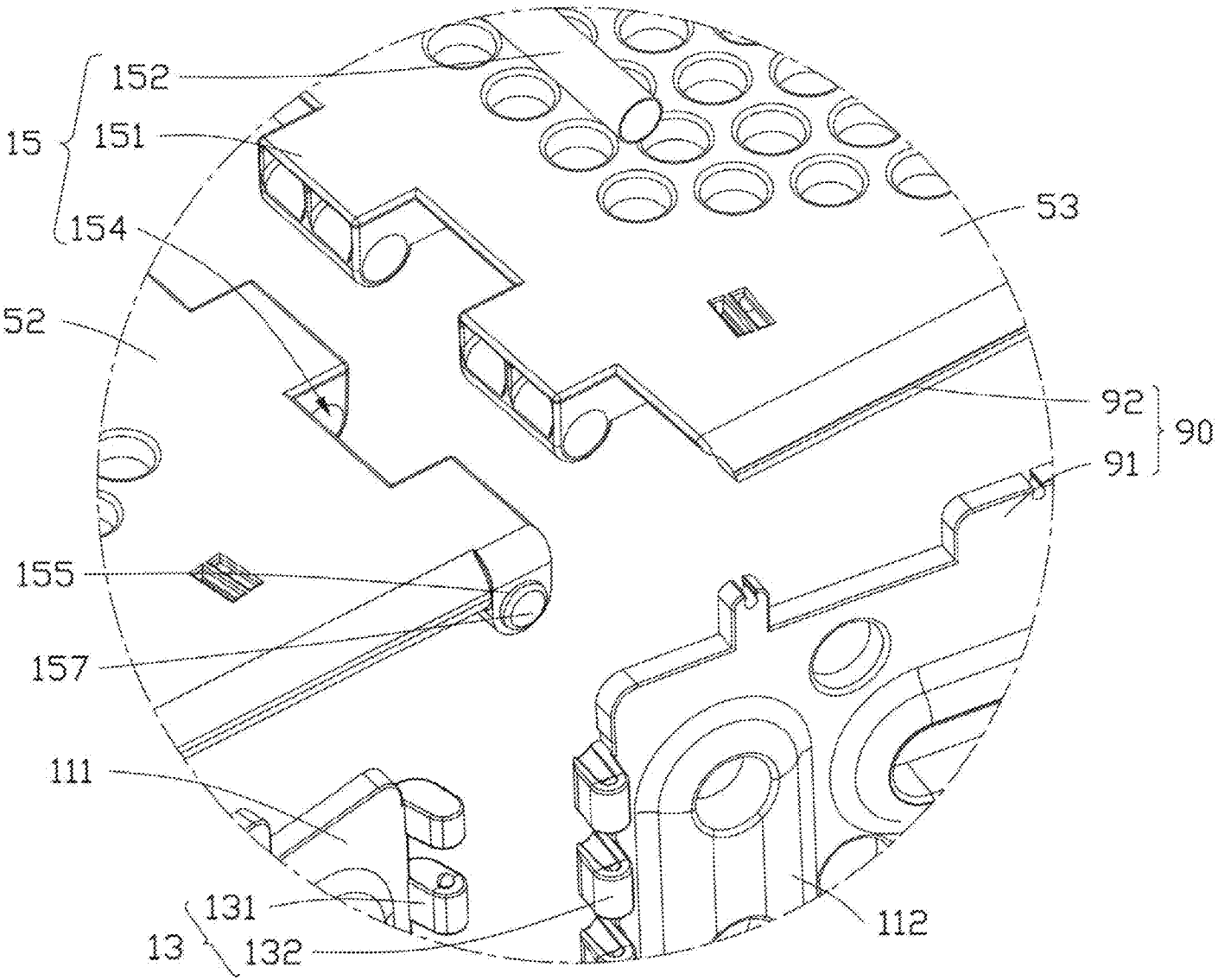
FIG. 7 is an enlarged schematic view of a region VII shown in FIG. 5.

Further, referring to FIG. 5 and FIG. 7, the second hinge element 13 includes a second connecting portion 131 and a second mating portion 132. The second connecting portion 131 is disposed on one of the first side plate 111 and the second side plate 112. The second mating portion 132 is disposed on the other of the first side plate 111 and the second side plate 112. The second connecting portion 131 is mated with the second mating portion 132 to hinge the first side plate 111 to the second side plate 112. In this embodiment, the second connecting portion 131 is disposed on the first side plate 111, and the second mating portion 132 is disposed on the second side plate 112. The second connecting portion 131 and the second mating portion 132 have the same structure as that of the first connecting portion 121 and the first mating portion 123 respectively, and thus details of the second connecting portion 131 and the second mating portion 132 are omitted. The first side plate 111 may be connected to the second side plate 112 through other hinge components, and should not be limited to the preceding embodiment.

Figure 8:
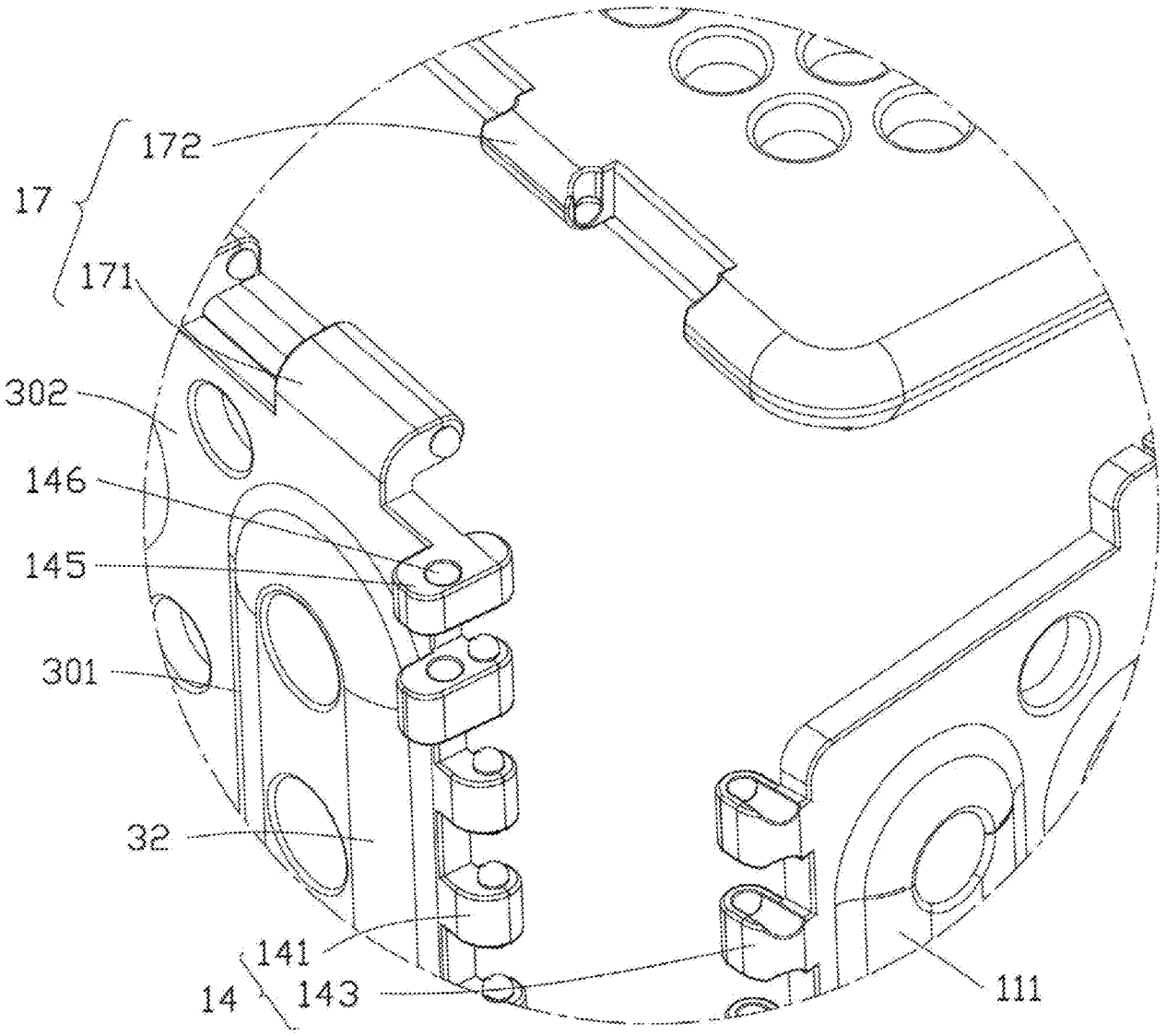
FIG. 8 is an enlarged schematic view of a region VIII shown in FIG. 5.

Further, referring to FIG. 5 and FIG. 8, the plurality of transverse boards 30 further includes two transverse headboards 32. The two transverse headboards 32 are respectively disposed on two ends of the collapsible bed frame 10. The plurality of middle transverse boards 31 is spaced between the two transverse headboards 32. In this embodiment, there are two middle transverse boards 31. In other embodiments, the quantity of middle transverse boards 31 may be adjusted as demanded and should not be limited to the preceding embodiment. The transverse headboards 32 are each hinged to the first side plate 111 or the second side plate 112 through a third hinge element 14. Specifically, the third hinge element 14 includes a plurality of third connecting portions 141 and a plurality of third mating portions 143. The third connecting portions 141 are disposed on one of the transverse headboard 32 and the first side plate 111, or on one of the transverse headboard 32 and the second side plate 112. The third mating portions 143 are disposed on the other of the transverse headboard 32 and the first side plate 111, or on the other of the transverse headboard 32 and the second side plate 112. In this embodiment, when a plurality of third connecting portions 141 is spaced on the transverse headboard 32, a plurality of third mating portions 143 is spaced on the first side plate 111 or the second side plate 112. The plurality of third connecting portions 141 and the plurality of third mating portions 143 have the same structure as that of the first connecting portion 121 and the first mating portion 123 respectively, and thus details of the third connecting portions 141 and the third mating portions 143 are omitted.

In this embodiment, similar to the first side plate 111 or the second side plate 112, a front surface of each of the plurality of transverse boards 30 includes at least a third region 301 and a fourth region 302. The third region 301 protrudes outward relative to the fourth region 302 to maintain stability of the collapsible bed 100 in the expanded state while keeping the collapsible bed 100 portable.

In this embodiment, the third region 301 is substantially elongated and is located on two sides or substantially located on the center of the transverse board 30. However, it should not be limited to the preceding embodiment.

In this embodiment, at least one of the third connecting portions 141 further includes an extension portion 145. A through hole 146 is provided on the extension portion 145. The through hole 146 is used for insertion of a support element 60.

In this embodiment, in the collapsible bed frame 10, the thickness of the first region 113 on the first side plate 111 and the second side plate 112 is greater than the thickness of the second region 114 thereon. In this way, the stability of the collapsible bed frame 10 in the expanded state can be enhanced, while keeping the collapsible bed 100 portable.

In this embodiment, the collapsible bed frame 10 and the collapsible bed board 50 are made of lightweight materials such as plastic. In addition, a plurality of holes are provided on the collapsible bed frame 10 and the collapsible bed board 50, so as to reduce the weight of the collapsible bed 100.

Referring to FIG. 2, FIG. 5, and FIG. 7, the collapsible bed board 50 comprises a plurality of bed board units 51. Each bed board unit 51 includes a first bed board 52 and a second bed board 53. As shown in FIG. 1A, in the expanded state, the plurality of bed board units 51 is disposed flat on the collapsible bed frame 10. As shown in FIG. 2, in the partially-collapsed state, the plurality of bed board units 51 are in a "V" shape. As shown in FIG. 3, in the collapsed state, the first bed boards 52 and the second bed boards 53 of the plurality of bed board units 51 overlap.

Specifically, referring to FIG. 7, the first bed board 52 is hinged to the second bed board 53 through a fourth hinge element 15. The fourth hinge element 15 includes a plurality of rotary portions 151 and a connecting rod 152. The plurality of rotary portions 151 is sleeved on the connecting rod 152, and the plurality of rotary portions 151 is respectively disposed on the first bed board 52 and the second bed board 53. It would be appreciated that the plurality of rotary portions 151 on the first bed board 52 and the plurality of rotary portions 151 on the second bed board 53 are alternately sleeved on the connecting rod 152. The plurality of rotary portions 151 are rotatable about an axis of the connecting rod 152, so as to facilitate the folding of the collapsible bed board 50. An assembly hole 154 extending through each rotary portion 151 is provided on the rotary portion 151 for receiving the connecting rod 152.

Figure 9:
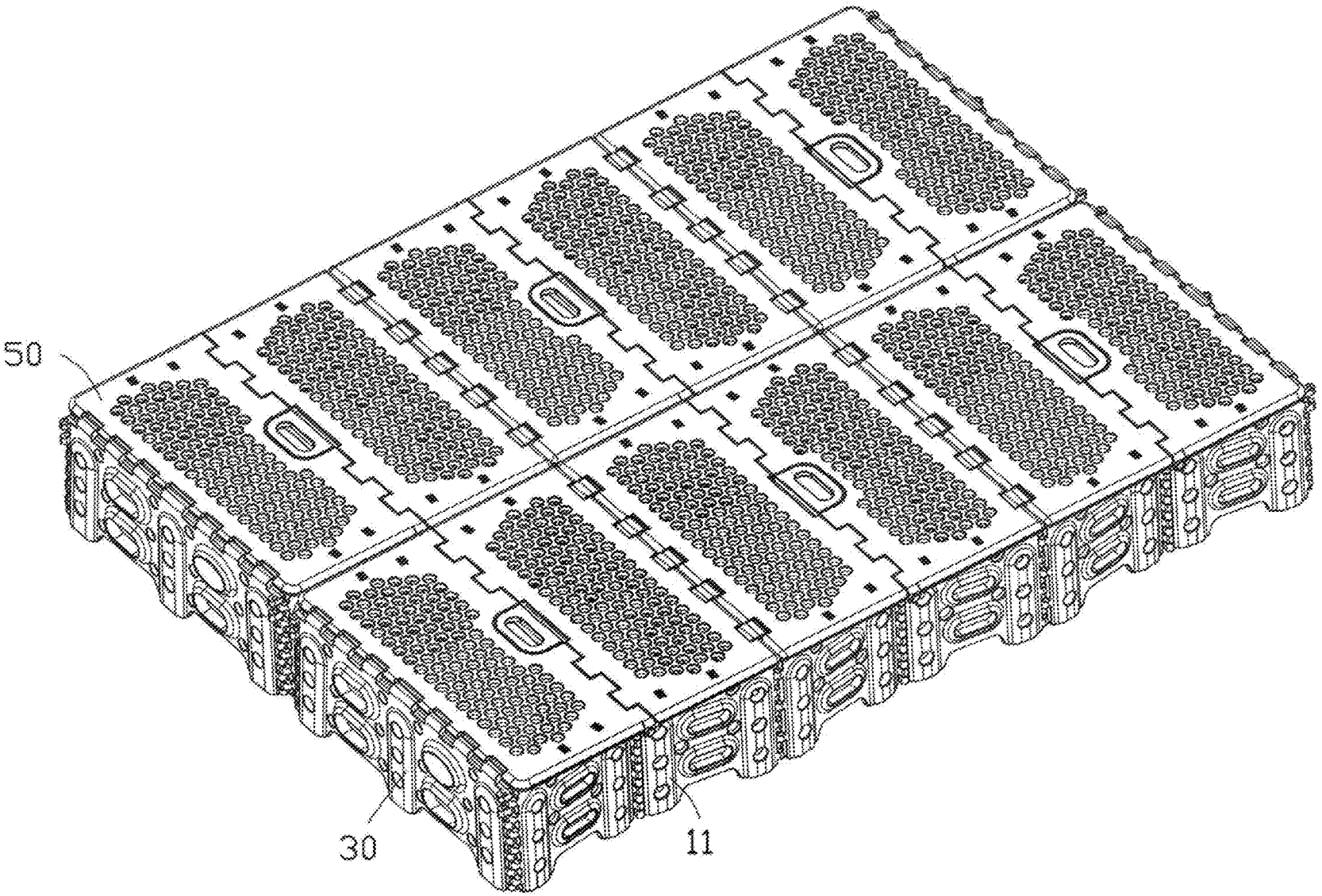
FIG. 9 is a three-dimensional structural schematic view of the collapsible bed shown in FIG. 2 in an expanded state.

Further, referring to FIG. 1A, FIG. 1B, FIG. 1C and FIG. 9, the fourth hinge element 15 further includes a first connecting member 155 and a second connecting member 156. The first connecting member 155 and the second connecting member 156 are respectively disposed on two ends of the connecting rod 152. An insertable portion 157 protrudes from the first connecting member 155 (as shown in FIG. 1B), and an insertion hole 158 is recessed on the second connecting member 156 (as shown in FIG. 1C), so as to assemble a plurality of collapsible beds 100 along a lateral axis of each collapsible bed 100 (as shown in FIG. 9). It would be appreciated that the outer diameter of the insertable portion 157 matches the inner diameter of the insertion hole 158, so as to firmly assemble the plurality of collapsible beds 100. It would be appreciated that the disposal and arrangement of the first connecting member 155 and the second connecting member 156 should not be limited, as long as adjacent collapsible beds 100 can be expanded. In this embodiment, the material of the insertion hole 158 includes a soft material (such as rubber), and the material of the insertable portion 157 includes a rigid material (such as plastic). As a result, the insertion hole 158 can be easily mated with the insertable portion 157, thereby making it easier to assemble the collapsible beds 100. The mating between the insertion hole 158 and the insertable portion 157 may also be realized in other ways and should not be limited to the preceding embodiment.

Further, referring to FIG. 4 and FIG. 5, the fourth hinge element 15 further includes a handle portion 159. The handle portion 159 is sleeved on the approximate middle of the connecting rod 152. An accommodating groove 54 is provided in the middle portion of one of the first bed board 52 and the second bed board 53, and a receiving groove 55 is provided at a corresponding position of the other of the first bed board 52 and the second bed board 53. The accommodating groove 54 and the receiving groove 55 are used for placing the handle portion 159 to provide enough space so that the handle portion 159 can be rotated about the connecting rod 152. As shown in FIG. 2, when the collapsible bed 100 is in the expanded state, the handle portion 159 is received in the accommodating groove 54 and the receiving groove 55, and the handle portion 159 and the collapsible bed board 50 are commonly on the same plane. In addition, as shown in FIG. 4, when the collapsible bed 100 is in the collapsed state, the handle portion 159 is received in the accommodating groove 54 and is on the same plane as the first bed board 52 or the second bed board 53.

Further, referring to FIG. 5 and FIG. 6, the bed board units 51 are hinged to each other through fifth hinge elements 16. Specifically, a fifth hinge element 16 includes a plurality of fifth connecting portions 161 and a plurality of fifth mating portions 162. The plurality of fifth connecting portions 161 is disposed on the first bed board 53 of one of adjacent bed board units 51 and on the second bed board 52 of the other of the adjacent bed board units 51. The plurality of fifth mating portions 162 is spaced on the middle transverse board 31. A fifth insertable portion 163 is formed on at least one side of each of the fifth connecting portions 161. Two fifth insertion grooves 164 are recessed on both sides of each of the plurality of fifth mating portions 162 along a longitudinal axis of the collapsible bed 100. The two fifth insertion grooves 164 are hinged to the fifth connecting portions 161 on the first bed board 51 and the second bed board 52 respectively, thereby connecting the bed board units 51 to the middle transverse board 31. The fifth insertable portion 163 and the fifth insertion groove 164 have the same structure as that of the first insertable portion 124 and the first insertion groove 125 respectively, and thus details of the fifth insertable portion 163 and the fifth insertion groove 164 are omitted. The bed board units 51 may also be hinged to each other in other ways and should not be limited to the preceding embodiment.

Further, referring to FIG. 5 and FIG. 8, the first bed board 52 and the second bed board 53 are hinged to the transverse headboard 32 through sixth hinge elements 17. Specifically, a sixth hinge element 17 includes a plurality of sixth connecting portions 171 and a plurality of sixth mating portions 172. The plurality of sixth connecting portions 171 are spaced on the transverse headboard 32, and the plurality of sixth mating portions 172 are spaced on the first bed board 52 or on the second bed board 53, so as to rotatably assemble the first bed board 52 or the second bed board 53 to the transverse headboard 32. The plurality of sixth connecting portions 171 and the plurality of sixth mating portions 172 have the same structure as that of the first connecting portion 121 and the first mating portion 123 respectively, and thus details of the plurality of sixth connecting portions 171 and the plurality of sixth mating portions 172 are omitted. In other implementations, the first bed board and the second bed board may also be hinged to the transverse headboard through other hinge components which is not limited to the preceding embodiment.

Further, as shown in FIG. 1A and FIG. 5, the collapsible bed 100 further includes a plurality of support elements 60. The plurality of support elements 60 is respectively located at four corners of the collapsible bed 100 for supporting and fixing a mosquito net. Each support element 60 includes a collapsible support rod 61 and a fixing member 63. Each of the support rods 61 is fixed in the through hole 146 of the transverse headboard 32, and the fixing member 63 is disposed at an end of the support rod 61 distal from the transverse headboard 32. In this embodiment, the fixing member 63 is made of an anti-slip material. It would be appreciated that, with the anti-slip material of the fixing member 63, the mosquito net can be effectively prevented from slipping off during use.

Figure 10:
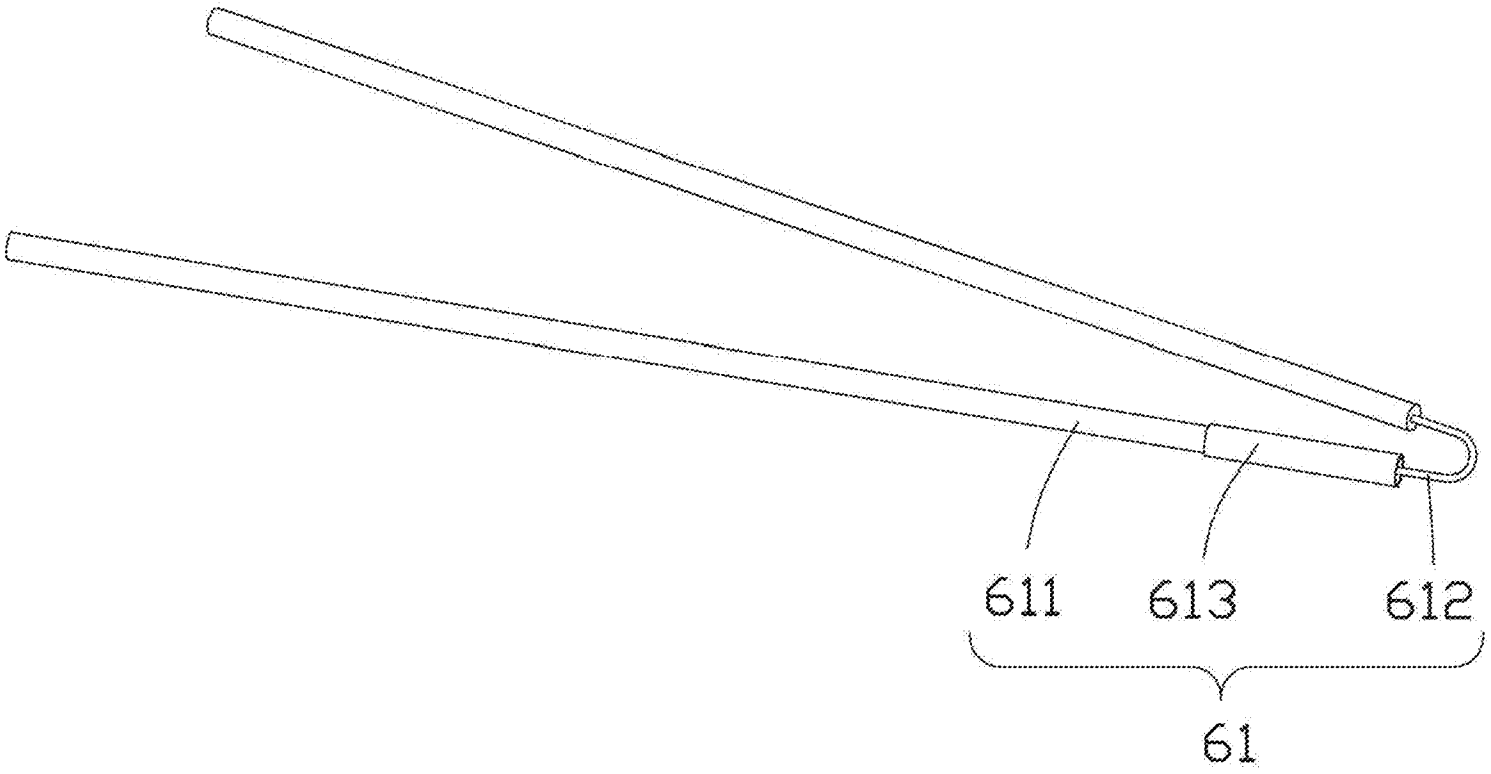
FIG. 10 is a view of a support rod in a support element shown in FIG. 1A in a collapsed state.

In this embodiment, referring to FIG. 5 and FIG. 10, the support rod 61 is transformable between an extended state and a collapsed state. The support rod 61 includes at least two rod bodies 611, an elastic member 612, and a connecting member 613. The at least two rod main bodies 611 are fixedly connected to each other through the connecting member 613, and the elastic member 612 is located within the rod main bodies 611. When the support rod 61 needs to be extended, the at least two rod bodies 611 are pulled apart, and the two adjacent rod bodies 611 are respectively fixedly connected to the two ends of the connecting member 613. When the support rod 61 needs to be collapsed, only one rod main body 611 of the support rod 61 needs to be disconnected from the connecting piece 613 and bent. The above structure is simple and is easily expanded. In this embodiment, the elastic member 612 is an elastic rope, and two ends of the elastic rope are respectively fixed to the two ends of the two rod bodies 611.

Further, referring to FIG. 7 again, the collapsible bed frame 10 and the collapsible bed board 50 are detachably connected through a fixing element 90. In this embodiment, the fixing element 90 includes a fixing portion 91 and a buckle portion 92. The fixing portion 91 is disposed on the first side plate 111 or/and the second side plate 112, and the buckle portion 92 is disposed on the first bed board 52 or the second bed board 53. In this way, when the collapsible bed 100 is in the expanded state, the fixing portion 91 is snapped in the buckle portion 92 to fix the collapsible bed frame 10 with the collapsible bed board 50.

During assembling of the collapsible bed 100, the plurality of side plates, the plurality of transverse boards 30, and the collapsible bed board 50 are expanded through various hinge elements. That is, each connecting portion is inserted into the corresponding circular groove by passing through the longitudinal groove, or the connecting portion is sleeved on the connecting rod. The structure of the collapsible bed 100 is simple, and after assembly, the collapsible bed 100 is ready to be used.

When the collapsible bed 100 needs to be collapsed, the collapsible units 110 of the two side bed frames 11 are collapsed. As shown in FIG. 3, the first side plates 111 and the second side plates 112 of the two side bed frames 11 are moved toward each other, and the middle portions of the first bed boards 52 and the second bed boards 53 of the plurality of bed board units 51 are moved away from the collapsible bed frame 10 for further collapsing. As shown in FIG. 4, the first bed boards 52 and the second bed boards 53 overlap, and the first side plates 111 and the second side plates 112 overlap. In this way, the collapsible bed 100 is easy to carry and store.

Compared with the prior art, in the collapsible bed frame 10 of the collapsible bed 100 provided in the present invention, due to the thickness of the first region 113 on the first side plate 111 and the second side plate 112 exceeding the thickness of the second region 114 thereof, the first side plate 111 and the second side plate 112 on the same side are prevented from bending away from the collapsible bed board when the collapsible bed is bearing weight. In this way, the stability of the collapsible bed frame 10 in the expanded state can be enhanced, and the collapsible bed 100 can be portable.

Figure 11:
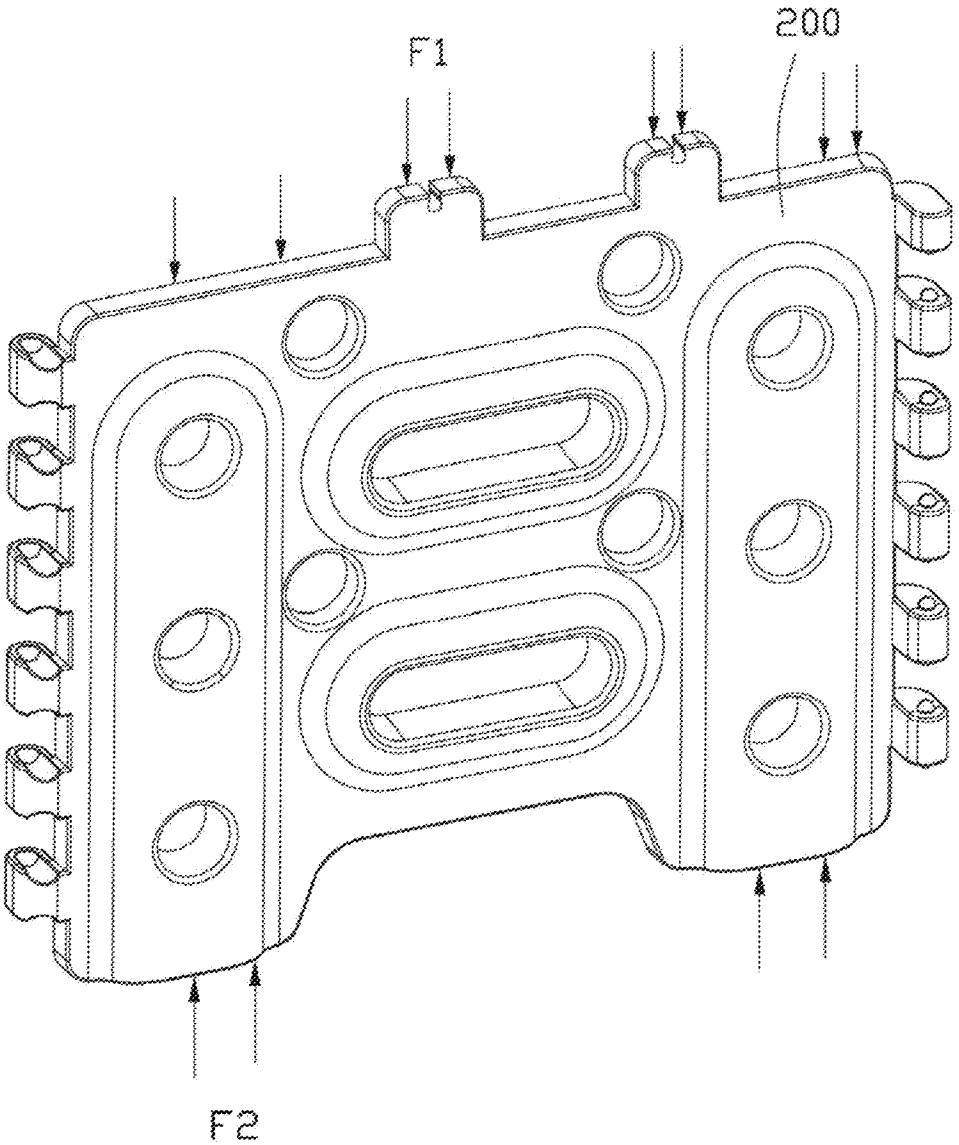
FIG. 11 is a view showing positions where force is applied to a collapsible bed according to Embodiment 1 of the present invention during a compression test.
Figure 12B:
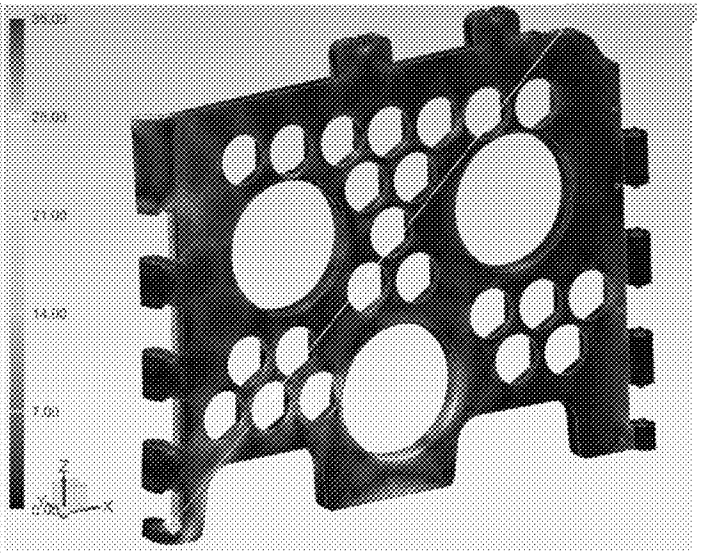
FIG. 12A and FIG. 12B respectively show stress distribution diagrams of a side plate of Embodiment 1 and a side plate of Comparative Example 1 after the same force is applied thereto.
Figure 12A:
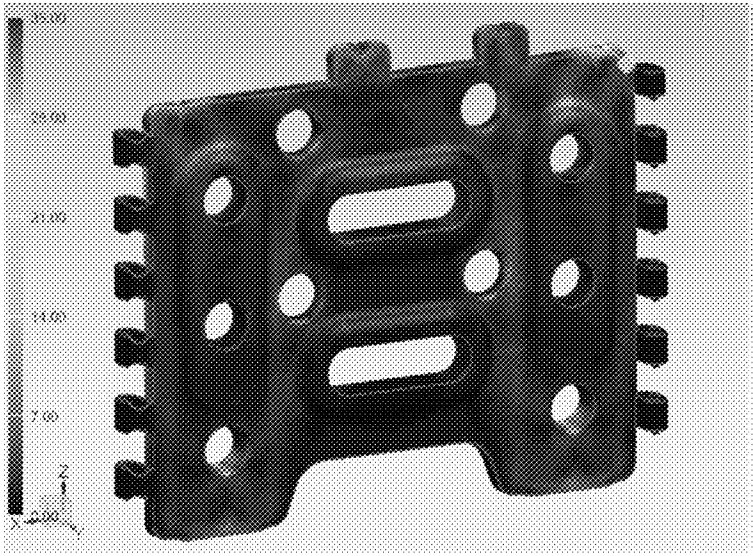
Figure 13B:
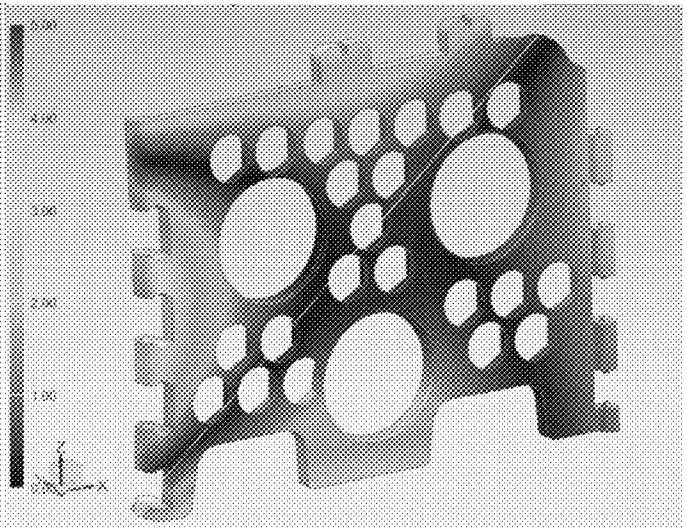
FIG. 13A and FIG. 13B respectively show deformation distribution diagrams of the side plate of Embodiment 1 and the side plate of Comparative Example 1 after the same force is applied thereto.
Figure 13A:
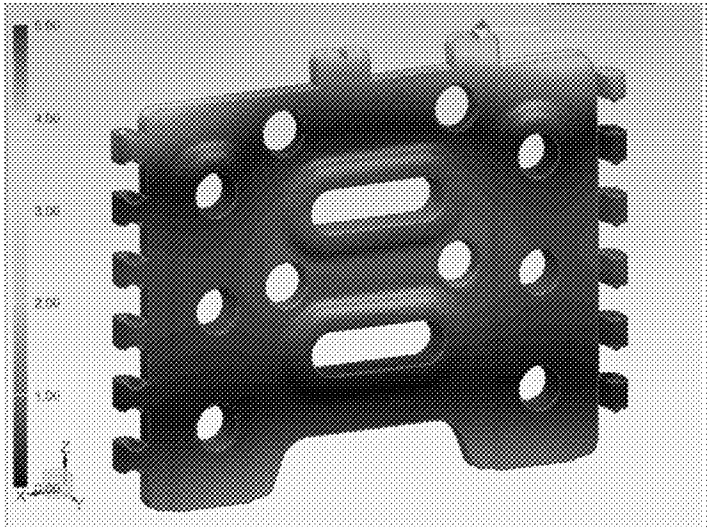

A compression resistance test was respectively performed on the side plate of Embodiment 1 of the present invention and a side plate of Comparative Example 1. As shown in FIG. 11, a total weight of 200 kg (i.e., F1+F2) is applied to upper and lower sides of the side plate (i.e., the first side plate 111 or the second side plate 112, which are cooperatively referred to as a side plate 200 below) of Embodiment 1. Results obtained after analysis using a simulation calculation method (through computer aided engineering, CAE)) are shown in FIG. 12A and FIG. 12B and FIG. 13A and FIG. 13B.

A difference between the side plate 300 of Comparative Example 1 and the side plate 200 of Embodiment 1 resides in that the side plate 300 includes no first region and/or second region, that is, a front surface of the side plate 300 is a planar surface.

Table 1 shows maximum stress values and maximum deformation values of Embodiment 1 and Comparative Example 1.

| | Embodiment 1 | Comparative Example 1 |
|---|---|---|
| Maximum stress value (Mpa) | 24.6142 | 49.4933 |
| Maximum deformation value (mm) | 2.87181 | 4.68073 |

It may be learned from Table 1 that the maximum stress value of the side plate 300 of Comparative Example 1 is approximately twice the maximum stress value of the side plate 200 of Embodiment 1, and the maximum deformation value of the side plate 300 of Comparative Example 1 is 1.63 times the maximum deformation value of the side plate 200 of Embodiment 1. It may be learned that, compared with Comparative Example 1, in Embodiment 1, the maximum stress value and the maximum deformation value of the side plate 200 decrease, indicating that the compression resistance is effectively improved.

Figure 14:
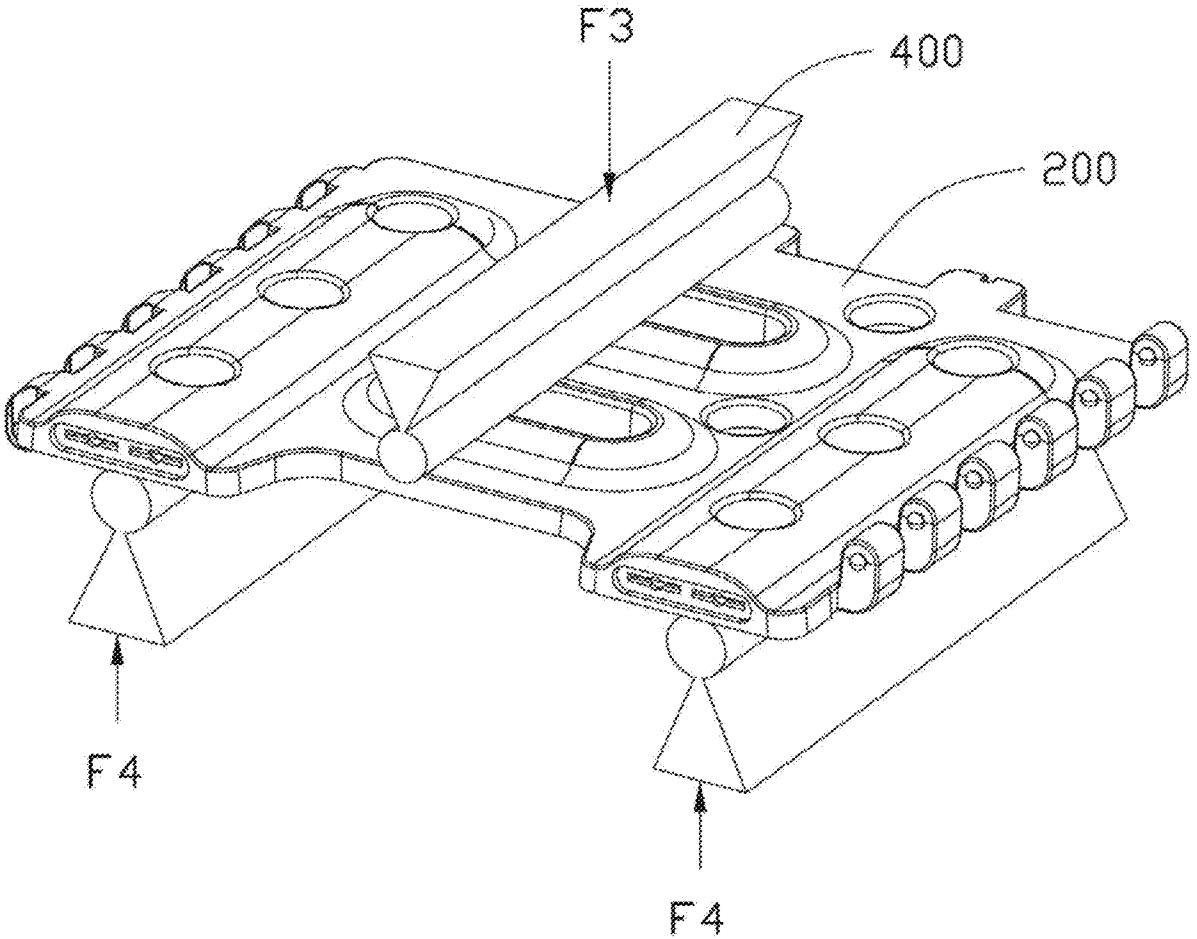
FIG. 14 is a view showing a state before force is applied to left and right sides of the side plate of Embodiment 1 using a three-point anti-bending table.
Figure 15B:
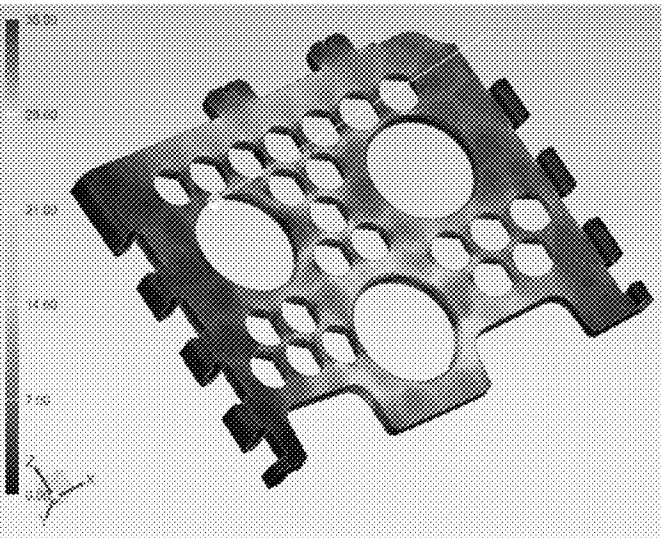
FIG. 15A and FIG. 15B respectively show stress distribution diagrams of the side plate of Embodiment 1 and the side plate of Comparative Example 1 using the three-point anti-bending table in FIG. 14.
Figure 15A:
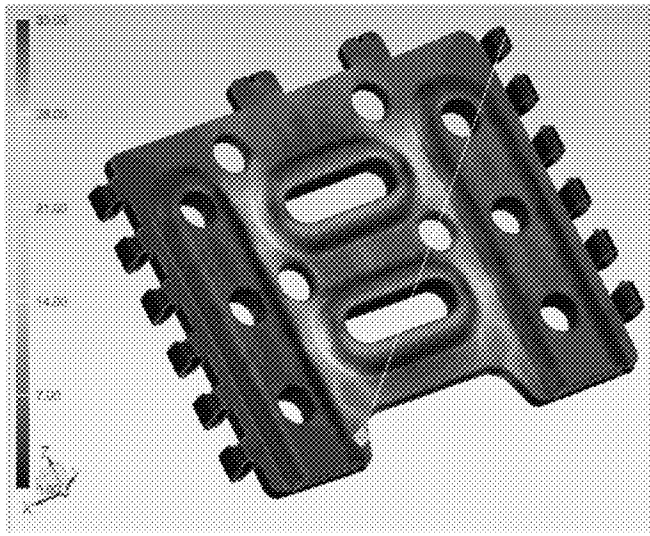
Figures 16A, 16B:
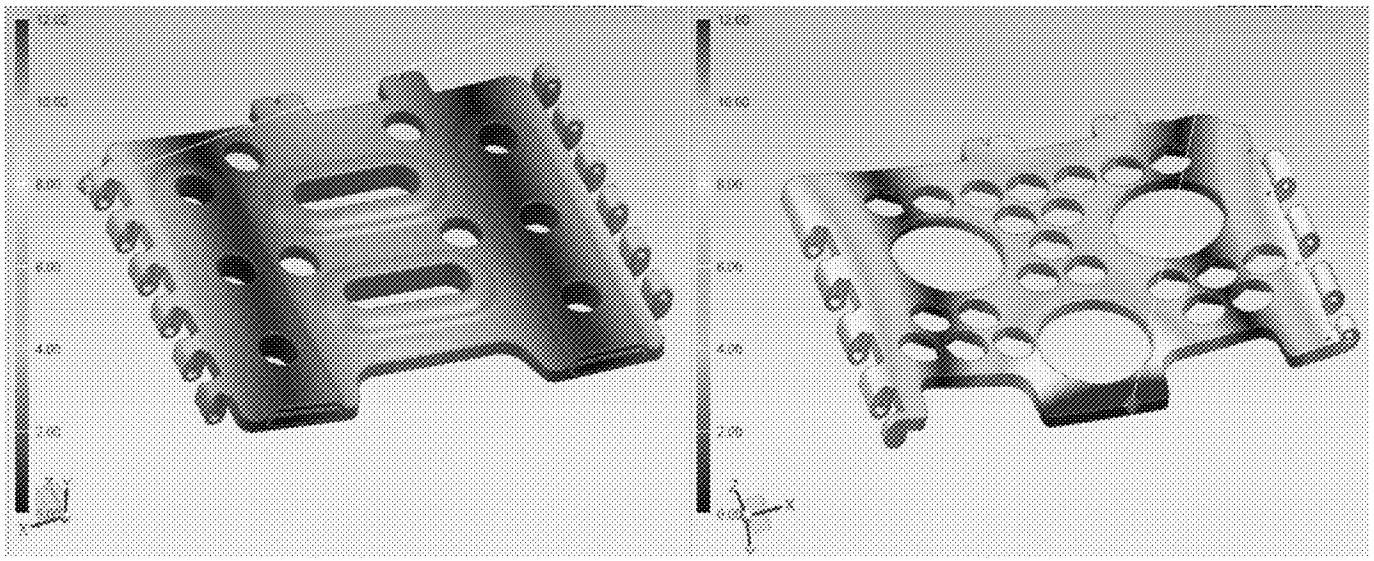
FIG. 16A and FIG. 16B respectively show stress distribution diagrams of the side plate of Embodiment 1 and the side plate of Comparative Example 1 using a three-point anti-bending table.

In the verification process, as shown in FIG. 14, a three-point anti-bending table 400 was used to apply a total force of 20 kg to the left and right regions and the middle region of the side plate 200 of Embodiment 1. A direction of the force F3 applied to the middle region is opposite to a direction of the force F4 applied to the left and right sides. Maximum stress values and maximum deformation values were obtained by analyzing changes of the side plate 200 after application of the force. The side plate 300 of Comparative Example 1 is tested in the same way. The results are shown in FIG. 15A and FIG. 15B and FIG. 16A and FIG. 16B.

Table 2 shows the maximum stress values and maximum deformation values of Embodiment 1 and Comparative Example 1.

| | Embodiment 1 | Comparative Example 1 |
|---|---|---|
| Maximum stress value of front surface (Mpa) | 27.4939 | 50.1984 |
| Maximum stress value of back surface (Mpa) | 27.4939 | 50.1984 |
| Maximum deformation value (mm) | 5.24546 | 13.9531 |

It may be learned from Table 2 that the maximum stress values and the maximum deformation values of the two surfaces of the side plate 300 of Comparative Example 1 are both far greater than the maximum stress values and the maximum deformation values of the two surfaces of the side plate 200 of Embodiment 1. It may be learned that, compared with Comparative Example 1, in Embodiment 1, the maximum stress values and the maximum deformation values decrease, indicating that the bending resistance is effectively improved.

Figure 17:
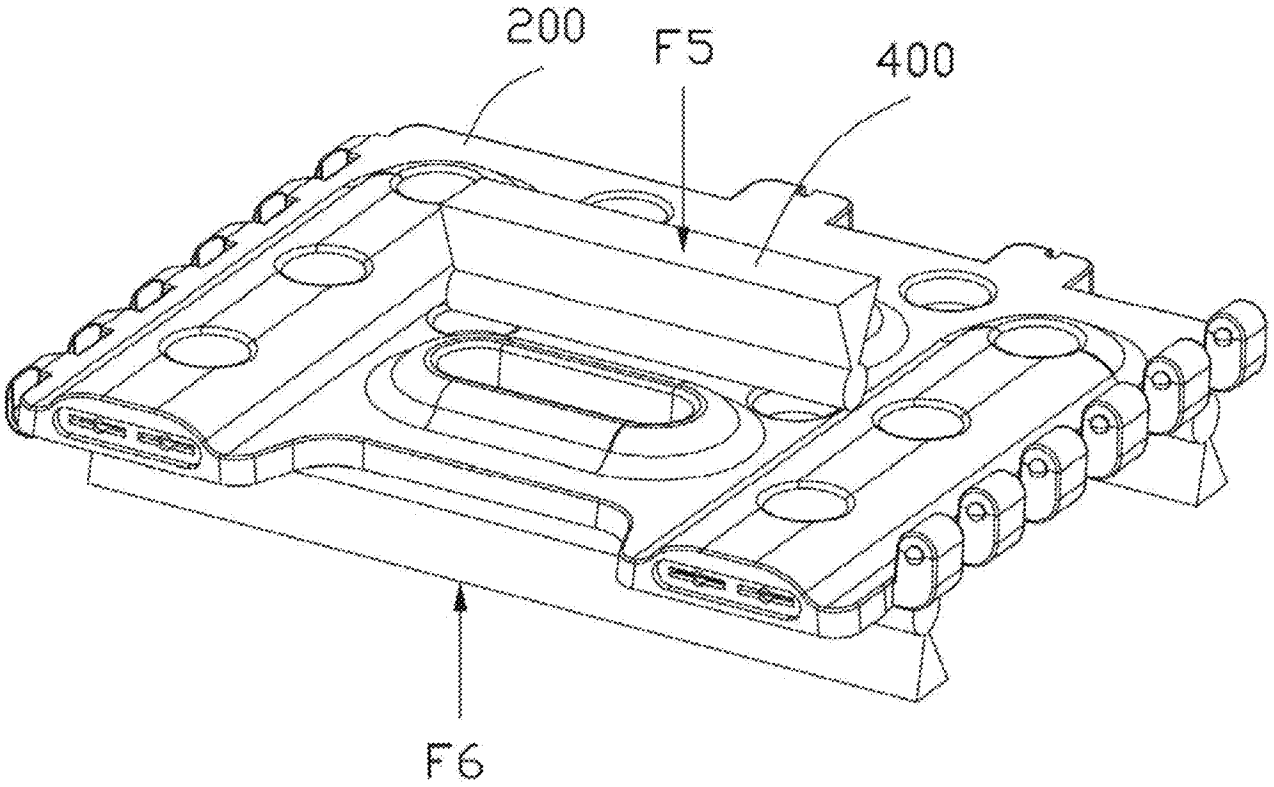
FIG. 17 is a view showing a state before force is applied to upper and lower sides of the side plate of Embodiment 1 using a three-point anti-bending table.
Figures 18A, 18B:
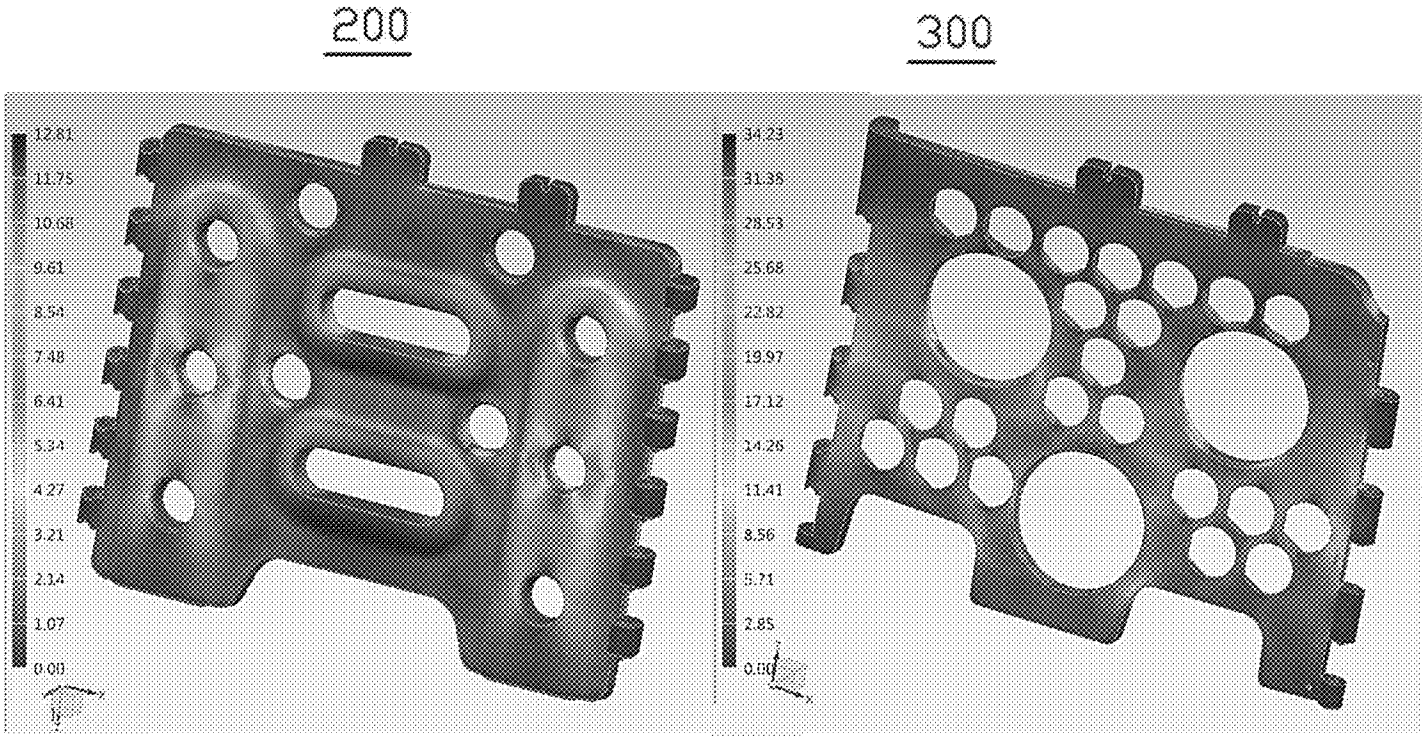
FIG. 18A and FIG. 18B respectively show stress distribution diagrams of the side plate of Embodiment 1 and the side plate of Comparative Example 1 using the three-point anti-bending table in FIG. 17.

As shown in FIG. 17, a three-point anti-bending table 400 was used to apply a total force of 20 kg to the upper and lower sides and the middle of the side plate 200 of Embodiment 1. Force F5 was applied to the middle region in a direction opposite to the force F6 applied to the upper and lower sides. The following maximum stress values and maximum deformation values were obtained by analyzing changes of the side plate 200 after application of the force. The side plate 300 of Comparative Example 1 was tested in the same way. The results are shown in FIG. 18A and FIG. 18B.

Table 3 shows the maximum stress values of Embodiment 1 and Comparative Example 1.

| | Embodiment 1 | Comparative Example 1 |
|---|---|---|
| Maximum stress value of front surface (Mpa) | 12.81 | 34.23 |

It may be learned from Table 3 that the maximum stress values of the side plate 300 of Comparative Example 1 are far greater than the maximum stress values of the side plate 200 of Embodiment 1. It may be learned that, compared with Comparative Example 1, in Embodiment 1, the maximum stress values decrease, indicating that the bending resistance is effectively improved.

Even though the above embodiments take multifunctional collapsible beds and bed frames as example, the present invention covers multifunctional collapsible platform frames and platforms having bear loading functions, etc. In addition, a person of ordinary skill in the art could make various corresponding changes and variations according to technical conceptions of this application, and such modifications and deformations shall fall within the scope of this application.

What is claimed is:

1. A collapsible bed frame, comprising two side bed frames and a plurality of transverse boards spaced between the two side bed frames, each side bed frame comprising a plurality of collapsible units, the collapsible units being hinged to the transverse boards through first hinge elements, and a second hinge element being disposed in a middle portion of each collapsible unit, so that the collapsible bed frame is transformable between an expanded state and a collapsed state, each collapsible unit comprising a first side plate and a second side plate, a front surface of the first side plate or the second side plate comprising at least a first region and a second region, and the first region protruding outward relative to the second region, wherein the first region includes a plurality of hollow protrusions, and the hollow protrusions include a pair of edge protrusions positioned adjacent to two edges of the first side plate or the second side plate and middle protrusions located between the edge protrusions, the edge protrusions and the middle protrusions are substantially elongated and orthogonal to each other.

2. The collapsible bed frame according to claim 1, wherein a front surface of each of the plurality of transverse boards comprises at least a third region and a fourth region, the third region protruding outward relative to the fourth region.

3. The collapsible bed frame according to claim 1, wherein the plurality of transverse boards comprise a middle transverse board, and each first hinge element comprises a plurality of first connecting portions and a plurality of first mating portions, the plurality of first connecting portions being spaced on the middle transverse board, the plurality of first mating portions being disposed on the first side plate of one of two adjacent collapsible units and the second side plate of the other of the two adjacent collapsible units, an insertable portion protruding from at least one side of each first connecting portion, and an insertion groove being recessed on each first mating portion for receiving the insertable portion, so as to hinge the middle transverse board to the side bed frame.

4. The collapsible bed frame according to claim 3, wherein the insertable portion is hemispherical, and the insertion groove comprises a longitudinal groove and a circular groove, to facilitate disassembly and assembly of the collapsible bed frame.

5. The collapsible bed frame according to claim 1, wherein the plurality of transverse boards comprise a transverse headboard, the transverse headboard being hinged to the first side plate or the second side plate through a third hinge element.

6. The collapsible bed frame according to claim 5, wherein the third hinge element comprises a third connecting portion and a third mating portion, the third connecting portion being disposed on one of the transverse headboard and the first side plate or on one of the transverse headboard and the second side plate, the third mating portion being disposed on the other of the transverse headboard and the first side plate or on the other of the transverse headboard and the second side plate, and the third connecting portion being hinged to the third mating portion.

7. The collapsible bed frame according to claim 6, wherein a plurality of third connecting portions are spaced on the transverse headboard, and a plurality of third mating portions are spaced on the first side plate or the second side plate, a through hole being provided on at least one of the third connecting portions, and the through hole being used for insertion of a support element.

8. A collapsible bed, comprising:

a collapsible bed frame, comprising two side bed frames and a plurality of transverse boards spaced between the two side bed frames, each side bed frame comprising a plurality of collapsible units, the collapsible units being hinged to the transverse boards through first hinge elements, and a second hinge element being disposed in a middle portion of each collapsible unit, so that the collapsible bed frame is transformable between an expanded state and a collapsed state, each collapsible unit comprising a first side plate and a second side plate, a front surface of the first side plate or the second side plate comprising at least a first region and a second region, and the first region protruding outward relative to the second region; and a collapsible bed board, comprising a plurality of bed board units, a fourth hinge element being disposed in a middle portion of each bed board unit, and adjacent bed board units being hinged through a fifth hinge element, so that the collapsible bed board is transformable between an expanded state and a collapsed state, and the bed board units being disposed on the collapsible bed frame in the expanded state, wherein the first region includes a plurality of hollow protrusions, and the hollow protrusions include a pair of edge protrusions positioned adjacent to two edges of the first side plate or the second side plate and middle protrusions located between the edge protrusions, the edge protrusions and the middle protrusions are substantially elongated and orthogonal to each other.

9. The collapsible bed according to claim 8, wherein each bed board unit comprises a first bed board and a second bed board, and the fourth hinge element comprises a connecting rod and a plurality of rotary portions, the plurality of rotary portions being sleeved on the connecting rod and respectively disposed on the first bed board and the second bed board, and the rotary portions on the first bed board being offset from the rotary portions on the second bed board.

10. The collapsible bed according to claim 8, wherein the collapsible bed further comprises a support element, the support element comprising a collapsible support rod and a fixing member, the support rod being fixed in a through hole of the transverse headboard, and when the support rod is in an expanded state, the fixing member is disposed at an end of the support rod that is away from the transverse headboard.

11. The collapsible bed according to claim 10, wherein the fixing member is made of an anti-slip material.

* * * * *